United States Patent [19]

Hobbs

[11] 4,003,575

[45] Jan. 18, 1977

[54] AMUSEMENT AND EXERCISE DEVICE

[76] Inventor: James D. Hobbs, 1337 79th St., Apt. 2, Newport News, Va. 23605

[22] Filed: Oct. 31, 1975

[21] Appl. No.: 627,795

[52] U.S. Cl. ..... 273/95 A; 273/DIG. 19; 46/62; 272/143

[51] Int. Cl.[2] ..... A63B 71/02

[58] Field of Search ..... 273/95 A, DIG. 19, 95 R, 273/26 R, 67 DB; 46/47, 61, 62, 82, 83; 272/75, 143; 280/11.37 H

[56] References Cited

UNITED STATES PATENTS

| | | | |
|---|---|---|---|
| 1,851,769 | 3/1932 | Hutchinson | 46/62 |
| 2,592,696 | 4/1952 | Hoody | 272/75 |
| 2,841,922 | 7/1958 | Kolintzas | 46/62 |
| 3,110,497 | 11/1963 | Broman | 273/95 A |
| 3,214,166 | 10/1965 | Gaudet | 273/26 E |
| 3,458,188 | 7/1969 | Infante | 273/DIG. 19 |
| 3,672,094 | 6/1972 | Vigorito | 46/62 |
| 3,747,929 | 7/1973 | Burke | 273/95 A |
| D200,421 | 2/1965 | Ruf | 46/62 |

*Primary Examiner*—Anton O. Oechsle
*Assistant Examiner*—Marvin Siskind
*Attorney, Agent, or Firm*—B. B. Olive

[57] ABSTRACT

An amusement and exercise device for use by one or two participants comprises a thin disc and a looped cord which passes through apertures in the disc. A pair of waistbands are secured to the opposed ends of the cord and are adapted to fit around the midsections of the participants. The disc is first set in spinning motion by a participant spinning the disc by hand, and the motion is maintained by each participant moving his waist inward and outward.

A pair of hollow, tubular hand grip members are slidably mounted on the remote ends of the cord enabling respective outer end loops to be formed for securement either around body portions of the user or alternatively around a belt worn by the user.

1 Claim, 12 Drawing Figures

AMUSEMENT AND EXERCISE DEVICE

BACKGROUND OF THE INVENTION

1. Field of the Invention

This invention relates to amusement and exercise devices which are set in operation by the movement of the participant's body and maintained in operation by such movement. More specifically, this invention relates to such amusement and exercise devices which are attached to and suspended between a pair of participants or a single participant and a stationary member.

2. Description of the Prior Art

Numerous toys have been patented which utilize a central disc member which is spun around by a cord passed through the disc. Such devices are held by the hands of the user and through an inward and outward movement of the hands causes the disc to spin. U.S. Pat. Nos. 249,922; 911,582; 2,739,419 and 3,052,060 are illustrative of toys of this type.

U.S. Pat. No. 3,110,497 provides a combination exercise and amusement device which utilizes a looped cord with a tubular member centrally mounted on the cord. A second cord is rotatably mounted on the tubular member with a ball attached to the free end of such second cord. The first cord passes about the hip area of the participants and the body movement of the participants keeps the ball in rotation about the tubular member as long as such body movement is maintained. However, the body movement required to sustain the rotation of the ball differs greatly from the body movement required by the present invention. The cord of the patented device, as opposed to the cord of the present invention, is not repeatedly twisted and released, but rather is moved in a continuous elliptical manner to impart rotation to the ball. The cord of the patented device remains substantially taut at all times, whereas the cord of the present invention moves from a taut to a relaxed state as it is twisted. Furthermore, the ball of the patented device moves in a continuous orbit while the disc of the present invention alternately spins in two directions.

SUMMARY OF THE INVENTION

An amusement or exercise device for use by one or two participants, in the preferred embodiment, comprises a thin disc which resembles a huge button and an elongated cord of a predetermined length which is passed through a first aperture in the disc and is fed back through a second aperture in the disc. The cord is tied or otherwise secured so that a closed loop is formed. A pair of waistbands or belt arrangments are secured to the opposed ends of the cord and are adjustable to accommmodate the waistlines of the participants.

The disc is first set in spinning motion by a participant spinning the disc by hand and thereby twisting the cord in one direction. The motion is maintained by each participant moving his waist inward and outward so as to twist and untwist the cord in both directions. While providing amusement and entertainment, the device also has therapeutic value in that it improves the muscle tone of the participate.

DESCRIPTION OF THE PREFERRED EMBODIMENT

Figure 1:
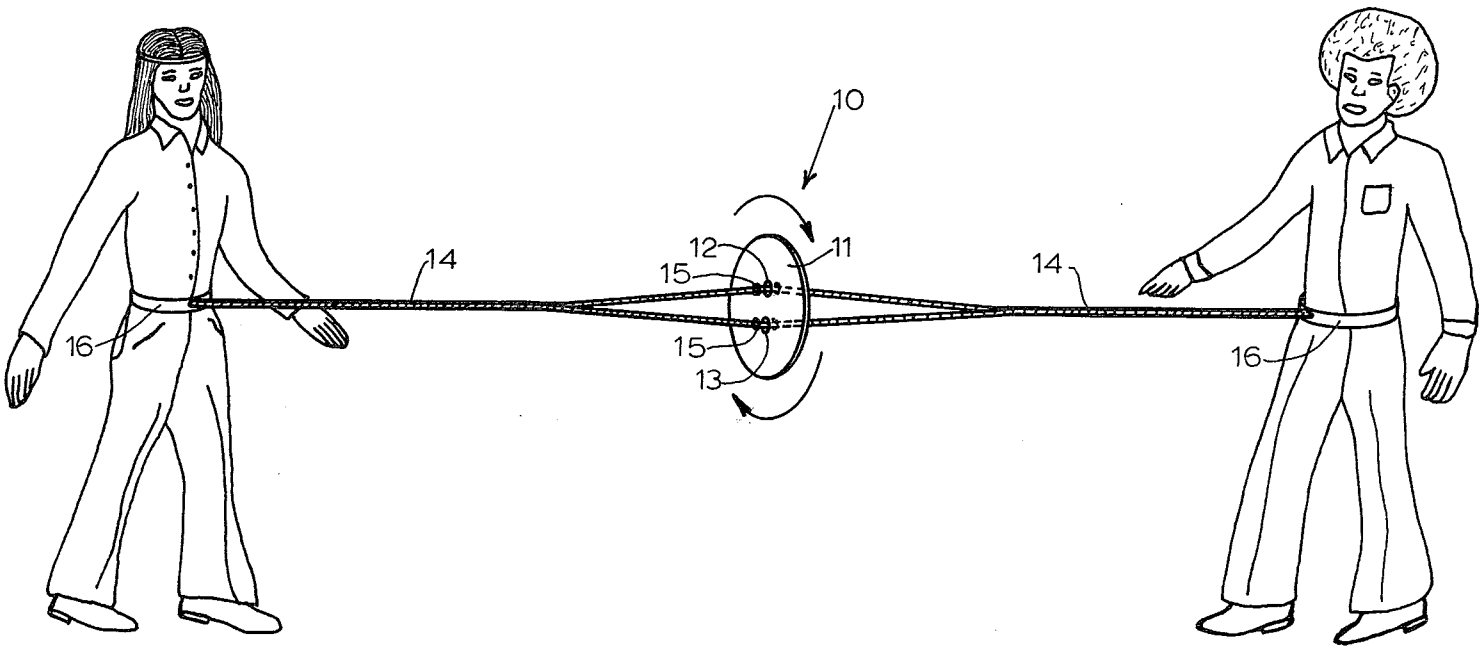
FIG. 1 is a perspective view of the device of the present invention showing the device being manipulated by two participants.
Figure 3:
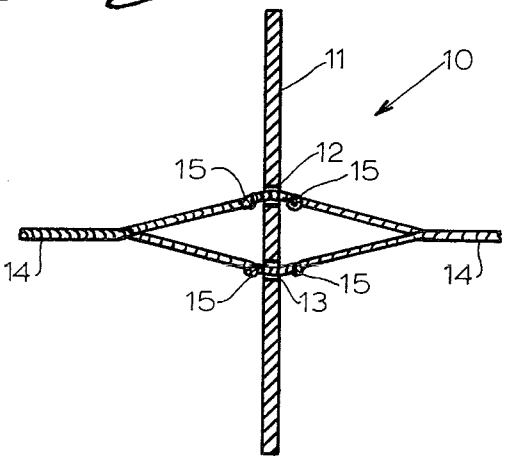
FIG. 3 is a fragmentary, enlarged section view through the disc of the preferred embodiment.
Figure 2:
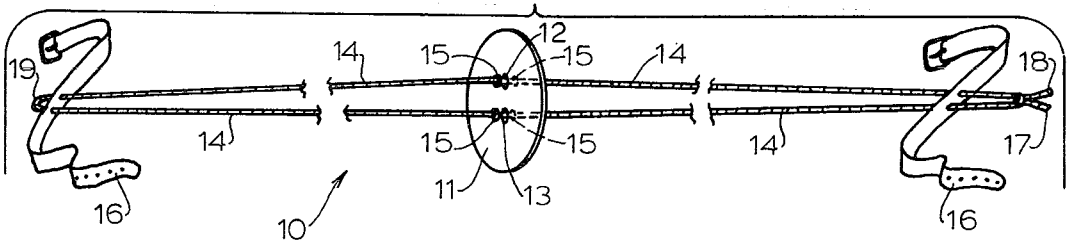
FIG. 2 is a perspective view of the apparatus of the invention of FIG. 1.
Figure 4:
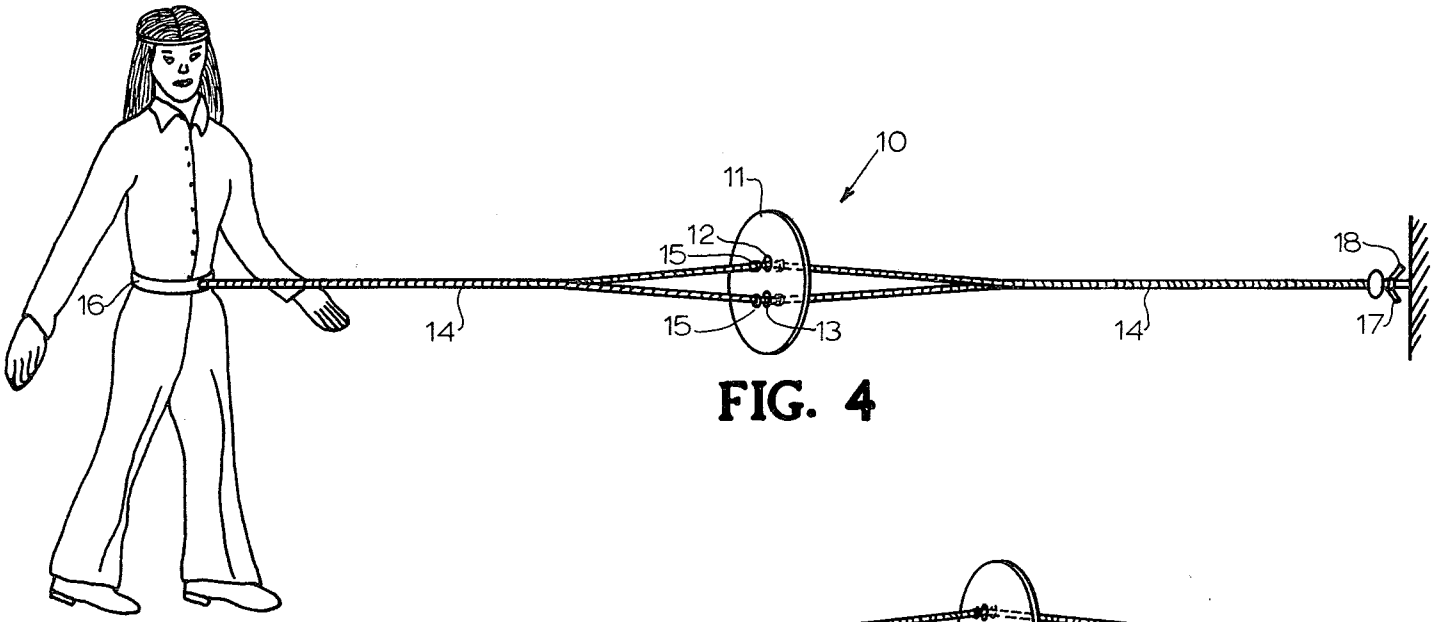
FIG. 4 is a perspective view of the invention showing the same being manipulated by one participant and with the opposite end affixed to a stationary object as, in this case, a door knob.

Referring to FIGS. 1 through 4 which illustrate the preferred embodiment of amusement and exercise device 10, reference character 11 designates a thin disc resembling a huge button. Disc 11 has a pair of apertures 12, 13 located near the center of disc 11. Disc 11 is approximately 12 inches in diameter. Apertures 12, 13 are each approximately 1 inch off center and disposed in substantial alignment with the center of disc 11. Disc 11 is approximately ⅛ inch to ¼ inch thick and is made from plywood, plastic, or any other relatively rigid material. Preferably, disc 11 has a smooth surface capable of receiving indicia. A cord 14 passes through aperture 12 and extends beyond disc 11 for a predetermined distance until it forms a turn 19. The remainder of cord 14 is fed through aperture 13 and terminates in two ends 17, 18 which are spaced approximately the same distance from disc 11 as in turn 19. The ends 17, 18 of cord 14 are then tied together to form a continuous loop which passes through disc 11 twice. Cord 14 preferably is a slightly flexible, tubular cord and in the preferred form is approximately eight feet in length before being formed into a loop. Knots 15 are tied in cord 14 on both sides of apertures 12, 13 when cord 14 is passed through so that disc 11 is maintained in a fixed location. Appropriate clamps or other means can be used instead of knots 15 to hold disc 11 in place. At each end of the closed loop formed by cord 14 is secured a waistband or belt 16. Belts 16 are adjustable in order to accommodate the waistline or various size participants participants. 14 is threaded through each of belts 16 prior to tying of the open end of loop 14.

Figure 5:
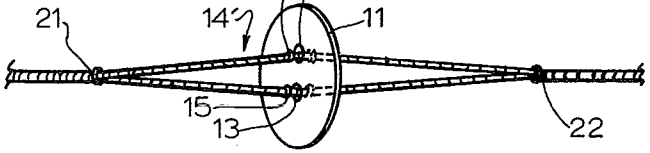
FIG. 5 is a fragmentary perspective view of a first alternative embodiment cord structure.

FIG. 5 illustrates a modified embodiment of the cord structure. Cord 14′ once it passes through apertures 12, 13 woven into a single strand as at 21, 22. The two strands comprising the loop portion between points 21 and 22 are adapted to twist upon themselves during operation. In addition, in order to supplement the twisting within the loop portion, it is desirable that the cord portions between points 21, 22 and the belts be made from a cord or twine that will independently twist and untwist, i.e., a cord or twine possessing radially elasticity.

Figure 6:
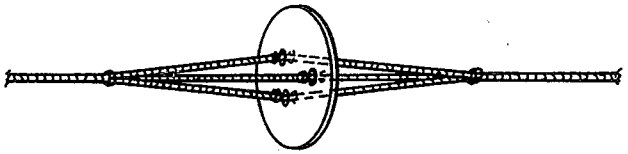
FIG. 6 is a fragmentary perspective view of a second alternative embodiment of the present invention illustrating a disc having three apertures.
Figure 7:
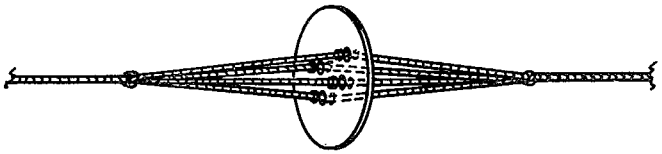
FIG. 7 is a fragmentary perspective view of a third alternative embodiment of the present invention illustrating a disc having four apertures.

It has been found that the disc of the invention can be provided with more than two holes so long as the loop portion has an equal number of strands to pass through the holes. As illustrated in FIGS. 6 and 7, discs with three equally spaced, annularly disposed apertures, or four annularly disposed apertures arranged in opposed pairs, can be made and used in accordance with the invention. In general, a device having more than four apertures and four strands in the loop portion becomes too complicated and unwieldy for satisfactory use.

The amusement or exercise device is designed for use by children and adults. The idea on which device 10 is based is that of keeping disc 11 alternately spinning in both directions by moving the body or waistline in and out thereby tightening and twisting cord 14.

For two players to operate the device, each player first fastens his respective belt 16 around his waist. Then one player walks to the middle of cord 14 and spins disc 11 with his hand so that the portions of cord 14 adjacent each of the belts 16 are twisted upon themselves. This player immediately rushes back to playing position so that a tension force can be applied to cord 14 by the players. The tension force causes the cord 14 to untwist and impart a rapid spinning motion to disc 11. As the cord 14 unwinds, the players relax the tension so that disc 11 by its own inertia will twist cord 14 in the opposite direction. When the rotation of disc 11 stops and cord 14 is fully twisted, the players once again apply tension to cord 14 to cause disc 11 to spin. This procedure is repeated to keep disc 11 in motion. If the device 10 is to be used by one individual, the player can accomplish the same motion by attaching the opposite end of cord 14 to a stationary object, e.g., a door knob (see FIG. 4).

It should be noted that in all illustrated embodiments of the invention the cord of the device forms a central loop portion comprising a plurality of strands which twist upon themselves in order to store and release the energy required to drive the disc. In the preferred embodiment illustrated in FIGS. 1 through 4, the central loop runs the entire length between the belts and is formed from two strands. In the alternative embodiments shown in FIGS. 6 and 7, the central loops also run the entire distance and are formed from three and four strands respectively. In the alternative embodiment shown in FIG. 5, the central loop runs a distance preferably less than two-thirds the distance between the belts, and the loop portion is formed from two strands which merge into a single cord at points 21 and 22.

Figure 8:
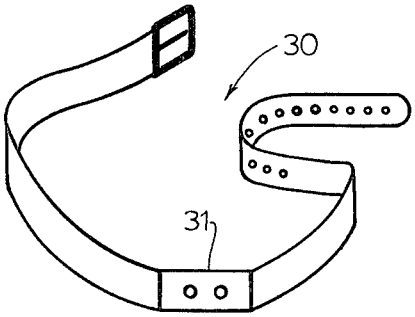
FIG. 8 is a perspective view of an alternate embodiment waistband or belt arrangement capable of employment with the present invention, the waistband having a rigid portion substantially midway thereof.

FIG. 8 illustrates an alternative embodiment waistband or belt 30 for use in protecting the participant's waist area should the belt be too flexible and twist as the cords twist. For this purpose, waistband 30 includes a substantially non-flexible or rigid secion 31 through which cord 14 passes and which may be formed of plastic, metal or the equivalent. As cord 14 twists, section 31 remains unflexed and prevents discomfort to the participant.

Figure 9:
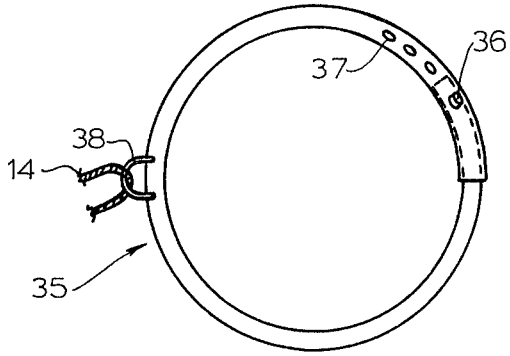
FIG. 9 is a perspective view of another waistband embodiment.

FIG. 9 illustrates still another alternative embodiment waistband 35. Waistband 35 is constructed as a hollow, circular tube, e.g. a hollow plastic tube, the free ends of which are designed so that one end will fit within the other allowing a button 36 on the inside portion to pass through one of a plurality of holes 37 in the outside portion thereby providing an adjustable securement. Cord 14 in turn passes through a bracket 38 which is rigidly secured to waistband 35.

Figure 10:
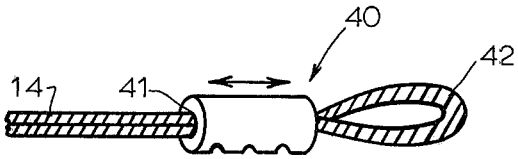
FIG. 10 is an enlarged, fragmentary perspective view of still another waistband for securing the device about the participant's waist or wrist.
Figure 11:
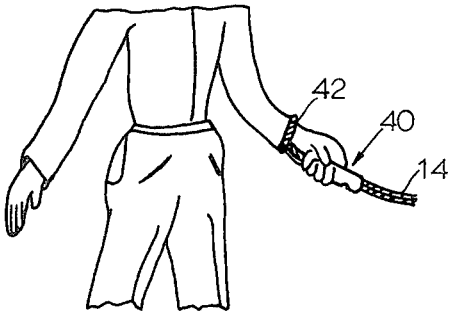
FIG. 11 is a fragmentary pictorial view of the FIG. 10 device used as a wrist securing device.
Figure 12:
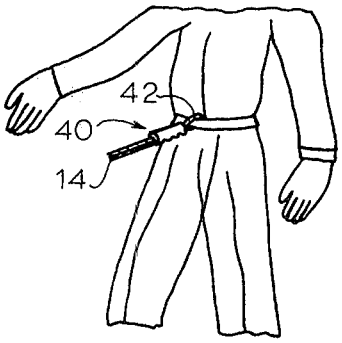
FIG. 12 is a fragmentary perspective view of the FIG. 10 device used as a waist securing device.

FIGS. 10, 11 and 12 illustrate a further alternative embodiment device for securing the device to the participant. A moveable grip 40 is cylindrical in shape with a hole 41 extending throughout the length and which receives cord 14. Grip 40 is slid forward or backward to lessen the diameter of the loop 42 formed in cord 14. FIG. 11 illustrates the device with loop 42 around the participant's wrist and tightened with the participant gripping grip 40 in his hand. FIG. 12 illustrates the same device with the participant's belt passed through loop 42 and grip 40 slipped downward toward the belt.

It has been found that the players must coordinate their body movements to a great extent in order to successfully operate the device. Use of the invention device results in a substantial therapeutic improvement to the muscle tone of the body while at the same time providing an amusement for both adults and children.

In summary, the present invention provides a novel amusement and exercise device adapted for use by people of all ages to enhance their muscle tone and coordination and to provide hours of recreational enjoyment.

What is claimed is:

1. An amusement and exercise device comprising:

a. a relatively thin, circular disc member having two apertures annularly disposed and circumferentially equally spaced about the center of said disc;

b. a cord member having a pair of opposed strands forming a closed loop and centrally mounting said disc member with each said strand passing through a respective one of said apertures; and c. a pair of hollow tubular hand grip members slidably mounted on the respective remote ends of said strands enabling respective outer end loop portions to be formed for selective securement around body portions of the user of the device or alternatively around a belt worn by the user.

* * * * *

UNITED STATES PATENT OFFICE

CERTIFICATE OF CORRECTION

Patent No. 4,003,575 Dated January 18, 1977

Inventor(s) James D. Hobbs

It is certified that error appears in the above-identified patent and that said Letters Patent are hereby corrected as shown below:

Column 1, line 63, "participate" should be --participant--.

Column 2, line 62, the second appearance of "participants" should be deleted.

Column 2, line 62, --Cord-- should be inserted before "14".

Column 2, line 66, --is-- should be inserted before "woven".

Signed and Sealed this

Fifth Day of April 1977

[SEAL]

*Attest:*

RUTH C. MASON
*Attesting Officer*

C. MARSHALL DANN
*Commissioner of Patents and Trademarks*